US012533000B2

(12) United States Patent
LaPorte

(10) Patent No.: US 12,533,000 B2
(45) Date of Patent: Jan. 27, 2026

(54) VACUUM HOSE HANDLE DEVICE

(71) Applicant: Rick LaPorte, Southington, CT (US)

(72) Inventor: Rick LaPorte, Southington, CT (US)

( * ) Notice: Subject to any disclaimer, the term of this patent is extended or adjusted under 35 U.S.C. 154(b) by 364 days.

(21) Appl. No.: 18/181,196

(22) Filed: Mar. 9, 2023

(65) Prior Publication Data

US 2023/0355067 A1 Nov. 9, 2023

Related U.S. Application Data

(60) Provisional application No. 63/338,215, filed on May 4, 2022.

(51) Int. Cl.

| | |
|---|---|
| ***A47L 9/04*** | (2006.01) |
| ***A47L 9/32*** | (2006.01) |
| *A47L 9/02* | (2006.01) |
| *A47L 9/06* | (2006.01) |

(52) U.S. Cl.
CPC ..... *A47L 9/327* (2013.01); *A47L 9/04* (2013.01); *A47L 9/02* (2013.01); *A47L 9/06* (2013.01)

(58) Field of Classification Search
CPC ..... A47L 9/00; A47L 9/04; A47L 9/06
See application file for complete search history.

(56) References Cited

U.S. PATENT DOCUMENTS

| | | | | |
|---|---|---|---|---|
| 5,797,162 | A | 8/1998 | Vystrcil | |
| 6,108,861 | A | 8/2000 | Vystrcil | |
| 6,348,078 | B1 | 2/2002 | Crismore | |
| 6,378,166 | B1 * | 4/2002 | Bruno | A47L 9/244 285/12 |
| 6,785,934 | B2 | 9/2004 | Bruno | |
| 8,205,296 | B1 * | 6/2012 | Bissell | A47L 9/04 15/421 |
| 9,702,101 | B1 * | 7/2017 | Ficks | E01H 1/0836 |
| 12,070,180 | B1 * | 8/2024 | Williamson | A47L 9/0606 |
| 2002/0092103 | A1 * | 7/2002 | Bruno | A47L 9/248 15/1 |
| 2005/0210627 | A1 * | 9/2005 | Luebbering | A47L 5/32 15/410 |
| 2006/0174442 | A1 | 8/2006 | Genoa | |
| 2008/0184517 | A1 * | 8/2008 | Phelan | F16L 37/252 15/300.1 |
| 2016/0031104 | A1 * | 2/2016 | Mascari | B26B 25/002 30/124 |

(Continued)

*Primary Examiner* — Michael D Jennings
(74) *Attorney, Agent, or Firm* — Brennan, Manna & Diamond, LLC

(57) ABSTRACT

The present invention relates generally to the field of vacuums. More specifically, the present invention relates to a vacuum hose handle device that is primarily comprised of a body and at least one handle. The device is specifically designed for use with a vacuum and attaches to a vacuum hose at a first end and a vacuum attachment at a second end. In one embodiment, the handle may be fixed to the body. In another embodiment, the handle may be attached to the body via at least one fastener. In the preferred embodiment, the device may be comprised of a rotating ring that allows the handle to rotate 360 degrees around the body, thereby allowing a user to maneuver the device from any angle. The device provides a user with a more comfortable way to vacuum with minimal effort, and without having to bend over.

9 Claims, 5 Drawing Sheets

(56) References Cited

U.S. PATENT DOCUMENTS

| | | | | |
|---|---|---|---|---|
| 2016/0174802 | A1* | 6/2016 | Conrad | A47L 9/1608<br>15/329 |
| 2017/0001327 | A1* | 1/2017 | Mascari | B26D 7/18 |
| 2017/0290484 | A1* | 10/2017 | Emmett | A47L 9/0045 |
| 2018/0353030 | A1* | 12/2018 | Wall | A47L 9/325 |
| 2022/0167812 | A1* | 6/2022 | Droguett Larrain | A47L 9/0606 |

* cited by examiner

VACUUM HOSE HANDLE DEVICE

CROSS-REFERENCE TO RELATED APPLICATION

The present application claims priority to, and the benefit of, U.S. Provisional Application No. 63/338,215 which was filed on May 4, 2022, and is incorporated herein by reference in its entirety.

FIELD OF THE INVENTION

The present invention relates generally to the field of vacuums. More specifically, the present invention relates to a vacuum hose handle device. The device is primarily comprised of a body and at least one handle, wherein the handle is further comprised of at least one grip area that allows the user to comfortably hold and use the device with minimal effort and without having to bend over in awkward positions to use the vacuum hose. Accordingly, the present disclosure makes specific reference thereto. Nonetheless, it is to be appreciated that aspects of the present invention are also equally applicable to other like applications, devices, and methods of manufacture.

BACKGROUND

By way of background, vacuums and shop vacs are commonly used by individuals for a variety of purposes. However, said vacuums often force users to bend over into awkward positions in order to vacuum certain areas. In addition, there is often no easy way to hold or operate the vacuum hoses comfortably. When users are forced to use vacuum hoses for extended periods of time, they often experience lower back pain. Further, vacuum hoses can force a user to vacuum on their knees, thereby causing more discomfort and pain.

Therefore, there exists a long-felt need in the art for an improved vacuum hose handle. Further, there exists a long-felt need in the art for a vacuum hose handle device that prevents a user from having to bend into awkward positions to use the vacuum hose. There also exists a long-felt need in the art for a vacuum hose handle device that allows a user to stand up straight while vacuuming, which thereby eliminates discomfort and pain. There also exists a long-felt need in the art for a vacuum hose handle that can be attached to a multitude of different vacuum hoses. Further, there exists a long-felt need in the art for vacuum hose handle device that can be used efficiently by both left-handed and right-handed users.

The subject matter disclosed and claimed herein, in one embodiment thereof, comprises a vacuum hose handle device. The device is primarily comprised of a body and at least one handle. The handle is further comprised of at least one grip area that allows the user to comfortably hold the device. The device can be used with a vacuum and attaches to a vacuum hose at a first end and a vacuum attachment at a second end. In one embodiment, the handle may be fixed to the body. In another embodiment, the handle may be attached to the body via at least one fastener. The body further may be comprised of at least one fastener located on the outer surface. The fastener allows the device to be attached to the vacuum, so the device does not get misplaced or lost when it is not in use.

In this manner, the vacuum hose handle device of the present invention accomplishes all of the foregoing objectives and provides a novel vacuum hose handle device that prevents the user from needing to vacuum in awkward positions. Further, the device provides a way for a user to use the vacuum hose pain-free. In addition, the vacuum hose handle device can be easily used by both left-handed and right-handed users.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a vacuum hose handle device. The device is primarily comprised of a body and at least one handle. The handle is further comprised of at least one grip area that allows the user to comfortably hold the device. The device can be used with a vacuum and attaches to a vacuum hose at a first end and a vacuum attachment at a second end. In one embodiment, the handle may be fixed to the body. In another embodiment, the handle may be attached to the body via at least one fastener. The body further may be comprised of at least one fastener located on the outer surface. The fastener allows the device to be attached to the vacuum such that the device does not get misplaced or lost when it is not in use.

In the preferred embodiment, the device may be comprised of at least one rotating ring that allows the handle to rotate 360 degrees around the body. This allows users to maneuver the device from any angle. The rotating ring further is comprised of at least one lock that allows the user to lock the handle in any position on the rotating ring, thus allowing the user to maneuver the device at a plurality of angles. The device may further be comprised of at least one strap that is further comprised of at least one strap fastener. The strap provides the user with a way to secure the vacuum hose to the user's arm.

Accordingly, the vacuum hose handle device of the present invention is particularly advantageous as it provides the user with a novel vacuum hose handle device that prevents the user from needing to bend into awkward positions when vacuuming. Further, the device provides a user with a way to vacuum more efficiently with minimal effort and minimal physical strain. In this manner, the vacuum hose handle device overcomes the limitations of existing vacuums known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
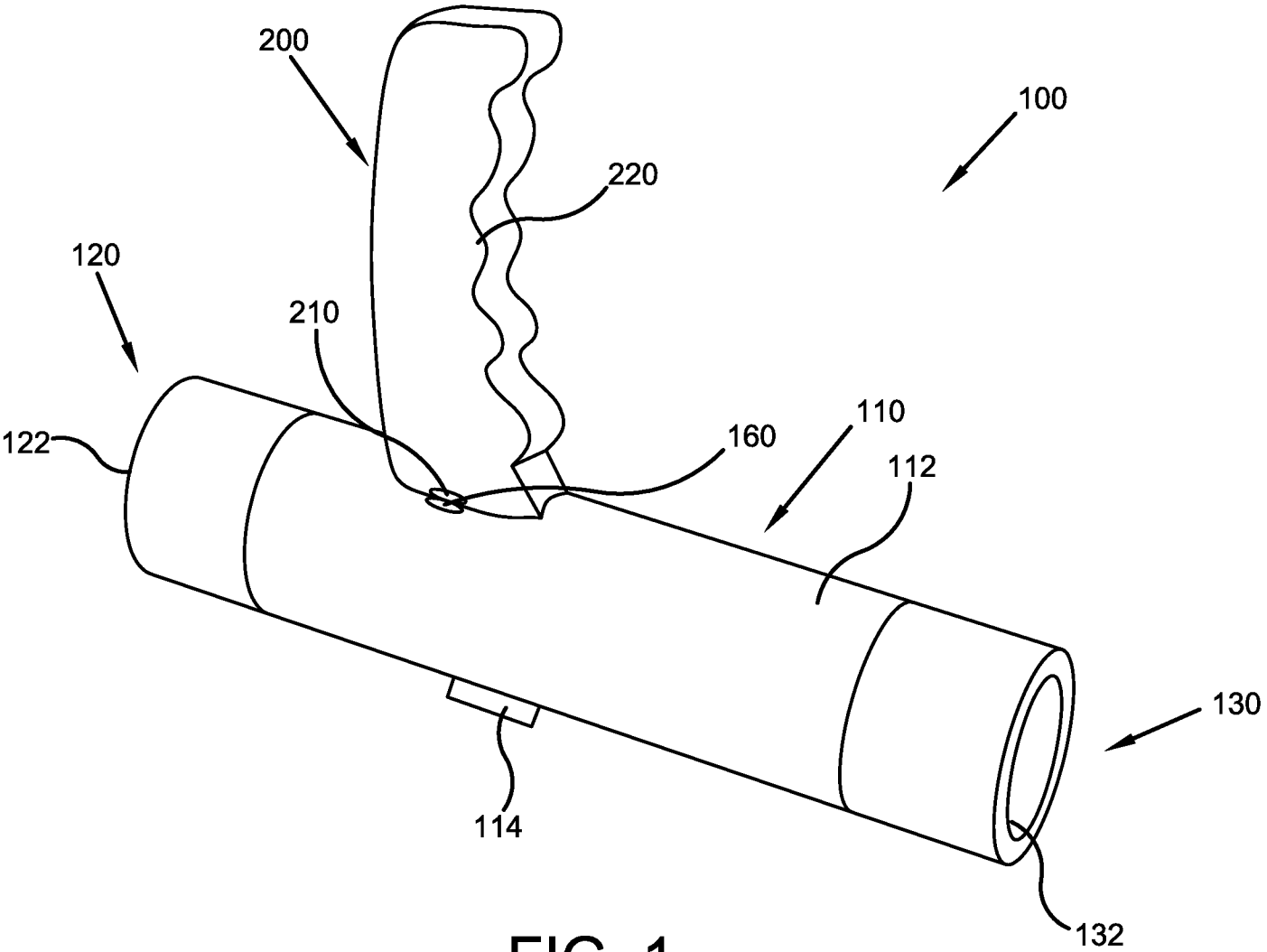
FIG. 1 illustrates a perspective view of one potential embodiment of a vacuum hose handle device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an improved vacuum hose handle. Further, there exists a long-felt need in the art for a vacuum hose handle device that prevents a user from having to bend into awkward positions to use a vacuum hose. There also exists a long-felt need in the art for a vacuum hose handle device that allows a user to stand up straight while vacuuming, thus eliminating discomfort and pain. There also exists a long-felt need in the art for a vacuum hose handle device that can be attached to a multitude of differentiating vacuum hoses. Further, there exists a long-felt need in the art for vacuum hose handle that can be used efficiently by both left-handed and right-handed users.

The subject matter disclosed and claimed herein, in one embodiment thereof, comprises a vacuum hose handle device. The device is primarily comprised of a body and at least one handle. The handle is further comprised of at least one grip area that allows the user to comfortably hold the device. The device can be used with a vacuum and attaches to a vacuum hose at a first end and a vacuum attachment at a second end. In one embodiment, the handle may be fixed to the body. In another embodiment, the handle may be removably attached to the body via at least one fastener. The body further may be comprised of at least one fastener located on the outer surface. The fastener allows the device to be attached to the vacuum, so the device does not get misplaced or lost when it is not in use.

In the preferred embodiment, the device may be comprised of at least one rotating ring that allows the handle to rotate 360 degrees around the body, thus allowing users to maneuver the device from any angle. The rotating ring further is comprised of at least one lock that allows the user to lock the handle in any position on the rotating ring, allowing the user to maneuver the device at a plurality of angles. The device may further be comprised of at least one strap, further comprised of at least one strap fastener. This provides the user with a way to secure the vacuum hose to the user's arm.

Referring initially to the drawings, FIG. 1 illustrates a perspective view of one potential embodiment of a vacuum hose handle device 100 of the present invention in accordance with the disclosed architecture. The device 100 is primarily comprised of a body 110 and at least one handle 200. The device 100 can be used with a vacuum 100 and attaches to a vacuum hose at a first end 120 and a vacuum attachment 30 at a second end 130.

In the preferred embodiment, the body 110 may be cylindrical in shape to allow the body 110 to attach to a multitude of different types of vacuum hoses 20. The body 110 further may be manufactured from a plurality of materials such as, but not limited to: rubber, wood, metal, plastic, etc. In the preferred embodiment, the body is comprised of a rigid plastic such as, but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, etc. In the preferred embodiment, the body 110 may be comprised of at least one fastener 114 located on the outer surface 112. The fastener functions as a way to attach the device to the vacuum 10 when it is not being used. There are a plurality of fasteners 114 that may be used such as, but not limited to: hook and loop, magnetic, adhesive, tongue and groove, etc. The fastener 114 prevents the user from misplacing the device 100 when it is not in use.

The body 110 is comprised of a first end 120 and a second end 130. The first end 120 is further comprised of a continuous opening 122 that allows the body 110 to attach to a vacuum hose 20. The second end 130 is further comprised of a continuous opening 132 that allows the body 110 to attach to a vacuum attachment 30. The openings 122, 132 may be any size that allow the device 100 to attach to any vacuum hose 20 and any vacuum attachment 30 known in the art.

The device 100 is further comprised of at least one handle 200 located on the outer surface 112 of the body 110. The handle 200 may be manufactured from any material known in the art but is preferably manufactured from a rigid plastic. The handle 200 is preferably made from a rigid plastic such as, but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, etc. The handle 200 is further comprised of at least one grip 220 that allows a user to comfortably hold the device 100. In one embodiment, the grip 220 is contoured to fit the user's hand. In another embodiment, the grip 220 may be any grip/non-slip material that is known in the art such as, but not limited to: silicone, ethylene-propylene, natural rubber, nitrile, neoprene, butyl, polyvinyl chloride, etc. In another embodiment, the grip 220 may be manufactured from a soft foam to allow the user to comfortably hold on to the device. In varying embodiments, the grip 220 may be any style of grip known in the art.

In one embodiment, the handle 200 may be fixed to the outer surface 112 of the body 110. In the fixed embodiment, the handle 200 is not removable from the body 110. In another embodiment, the handle 200 is removable and can be attached/detached via at least one fastener 210. The outer surface 112 is further comprised of at least one reciprocating fastener 160 that receives the handle fastener 210 and allows the handle 200 to be attached thereto. There are a plurality of fasteners 210, 160 that may be used such as, but not limited to: tongue and groove, hook and loop, magnetic, etc. In another embodiment, the body 110 may have a second handle 200 that is perpendicular to the first handle 200 to provide a user with further control, stability, and handling options while using the device 100.

Figure 2:
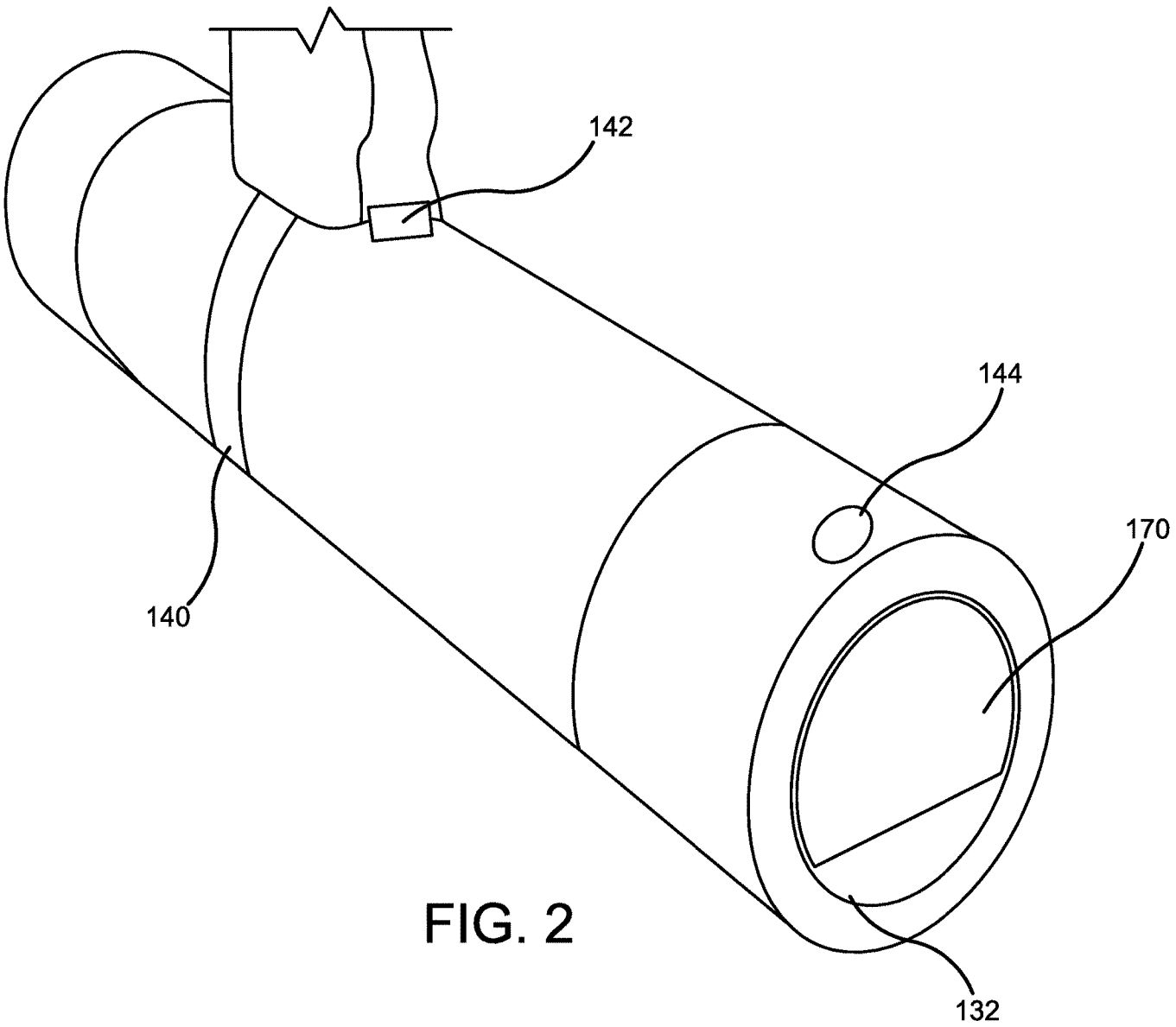
FIG. 2 illustrates an enhanced perspective view of a second end of one potential embodiment of a vacuum hose handle device of the present invention in accordance with the disclosed architecture.

FIG. 2 illustrates an enhanced perspective view of a second end 130 of one potential embodiment of a vacuum hose handle device 100 of the present invention in accordance with the disclosed architecture. The device 100 may be comprised of at least one internal stopper 170 located in the second end 130 at the opening 132. The internal stopper 170 may be engaged/disengaged via at least one button 144. The button 144 may be located on the outer surface 112 of the body 110. When a user engages the internal stopper 170 by pressing the button 144, the suction created by the vacuum 10 is cut off due to the stopper 170 blocking the opening 132 in an air-tight fashion. This is particularly advantageous as it provides a user with a way to essentially turn off the suction of the vacuum 10 without having to physically power off the vacuum 10.

The internal stopper 170 may be manufactured from any material that is known in the art, but it is preferably rubber. There are a plurality of rubbers that may be used such as, but not limited to: natural rubbers, neoprene rubber elastomer, silicone rubber elastomer, ethylene propylene diene monomer rubber, butyl rubber, nitrile rubber, buna-n rubber, styrene-butadiene rubber elastomers, Viton rubber elastomer, diaphragm rubber, thermoplastic rubber, etc. The button 144 may be any button that is known to one skilled in the art.

The device 100 may be further comprised of at least one rotating ring 140 located on the outer surface 112 of the body 110. The rotating ring 140 is preferably made from a rigid plastic material such as, but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, etc. In an embodiment of the device 100 with a fixedly attached handle 200, the handle 200 is fixedly attached to the rotating ring 140. In an embodiment of the device 100 with a removably attached handle 200, the handle 200 is removably attached to the rotating ring 140 via at least one fastener 160 such as, but not limited to: hook and loop, tongue and groove, magnetic, snap button, etc. The rotating ring 140 permits the handle 200 to rotate around the body 100 a full 360 degrees. This allows the user to position the handle 200 in any position that the user desires.

The rotating ring 140 further is comprised of at least one lock 142. The lock 142 allows a user to be able to lock the handle 200 in any position on the rotating ring 140 without the risk of the handle 200 moving while the user is holding it. The lock 142 can be a plurality of locks such as, but not limited to: push button, slide lock, twist lock, etc.

Figure 3:
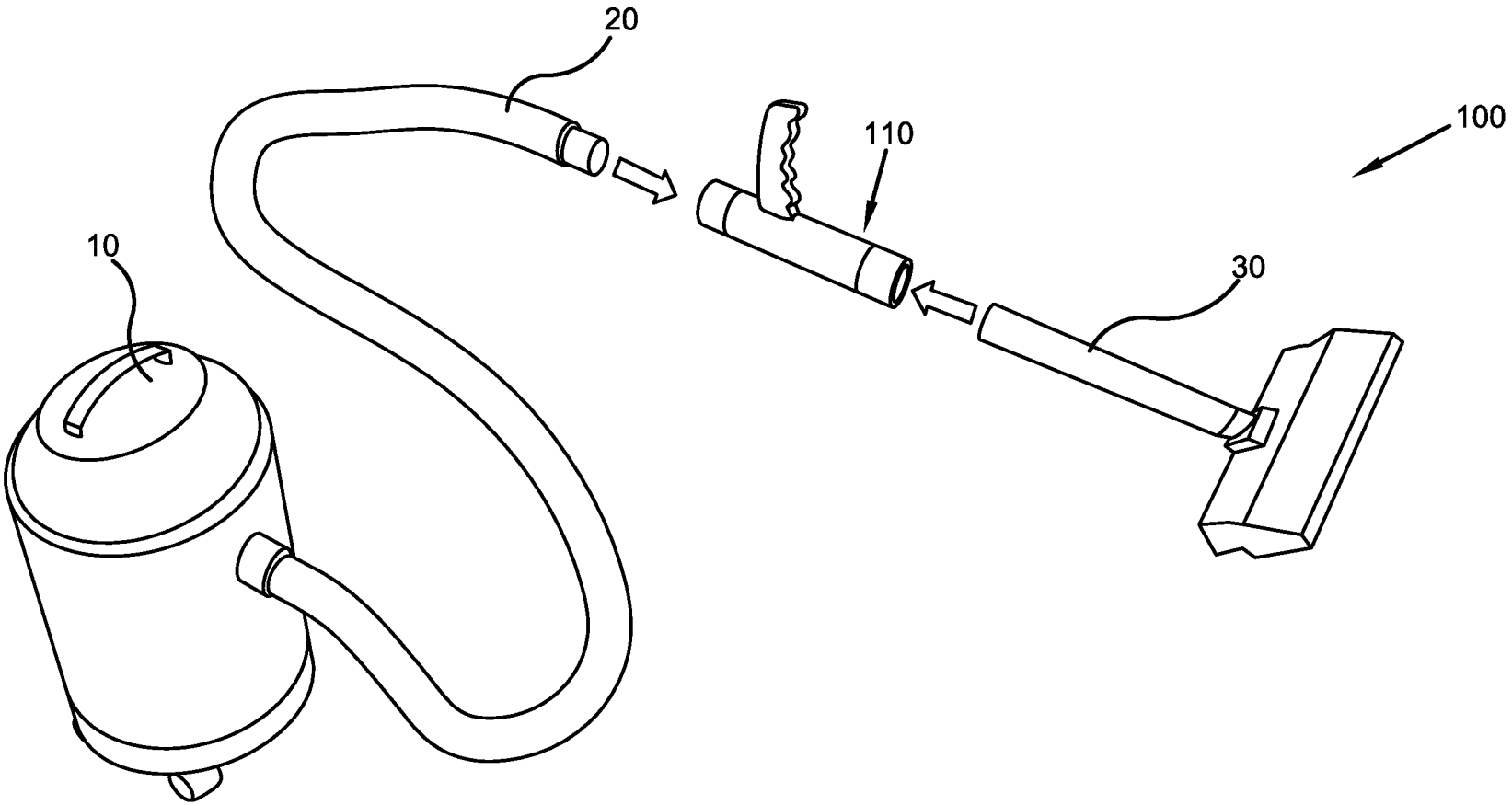
FIG. 3 illustrates an exploded view of one potential embodiment of a vacuum hose handle device of the present invention, a vacuum, a vacuum hose, and a vacuum attachment in accordance with the disclosed architecture.

FIG. 3 illustrates an exploded view of one potential embodiment of a vacuum hose handle device 100 of the present invention, a vacuum 10, a vacuum hose 20, and a vacuum attachment 30 in accordance with the disclosed architecture. The body 110 is connected to the vacuum hose 20 via the first end 120 opening 122, and to the vacuum attachment 30 via the second end 130 opening 132. In one embodiment, the vacuum hose 20 and the vacuum attachment 30 are attached to the body 110 by sliding the pieces into the openings 122, 133. This allows the vacuum hose 20 and the vacuum attachment 30 to fit tightly into the body 110. In another embodiment, the vacuum hose 20 and the vacuum attachment 30 are threaded and may be connected to the body 110 by twisting the threaded pieces into the body 110, wherein the openings 122,132 of the body 110 are also threaded.

Figure 4:
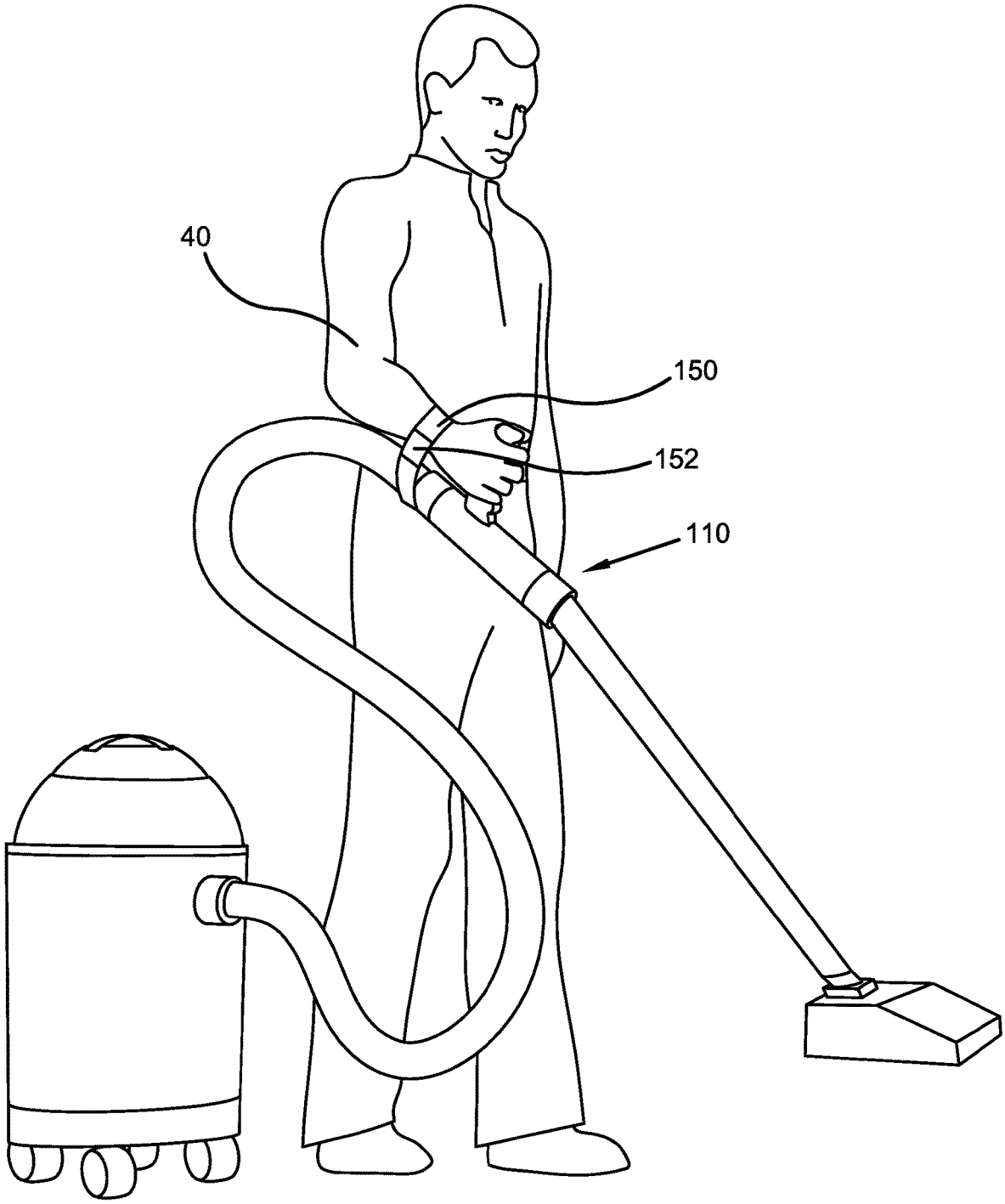
FIG. 4 illustrates a perspective view of one potential embodiment of a vacuum hose handle device of the present invention while attached to a vacuum, a vacuum hose, and a vacuum attachment in accordance with the disclosed architecture.

FIG. 4 illustrates a perspective view of one potential embodiment of a vacuum hose handle device 100 of the present invention while attached to a vacuum 10, a vacuum hose 20, and a vacuum attachment 30 in accordance with the disclosed architecture. The device 100 is further comprised of at least one strap 150. The strap 150 may be any strap known in the art, such as, but not limited to, an elastic strap. The strap 150 further can be made of any material that is known in the art. The strap 150 may also have at least one strap fastener 152 that allows the strap 150 to be tightened/loosened. There are a plurality of straps fasteners 152 that may be used such as, but not limited to: buckle, snap button, hook and loop, tongue and groove, etc.

The strap 150 allows a user to attach the device 100 to the arm 40 of the user. This prevents the device 100 from falling out of the user's hand thus risking damage to the device 100. The strap 150 allows the user to not have to hold the whole weight of the vacuum hose 20 and the vacuum attachment 30. Further, having the strap allows the user to place more of the vacuum weight on the arm 40 of the user instead of all of it on the handle 200. This allows the user to be able to maneuver the device 100 with less effort.

Figure 5:
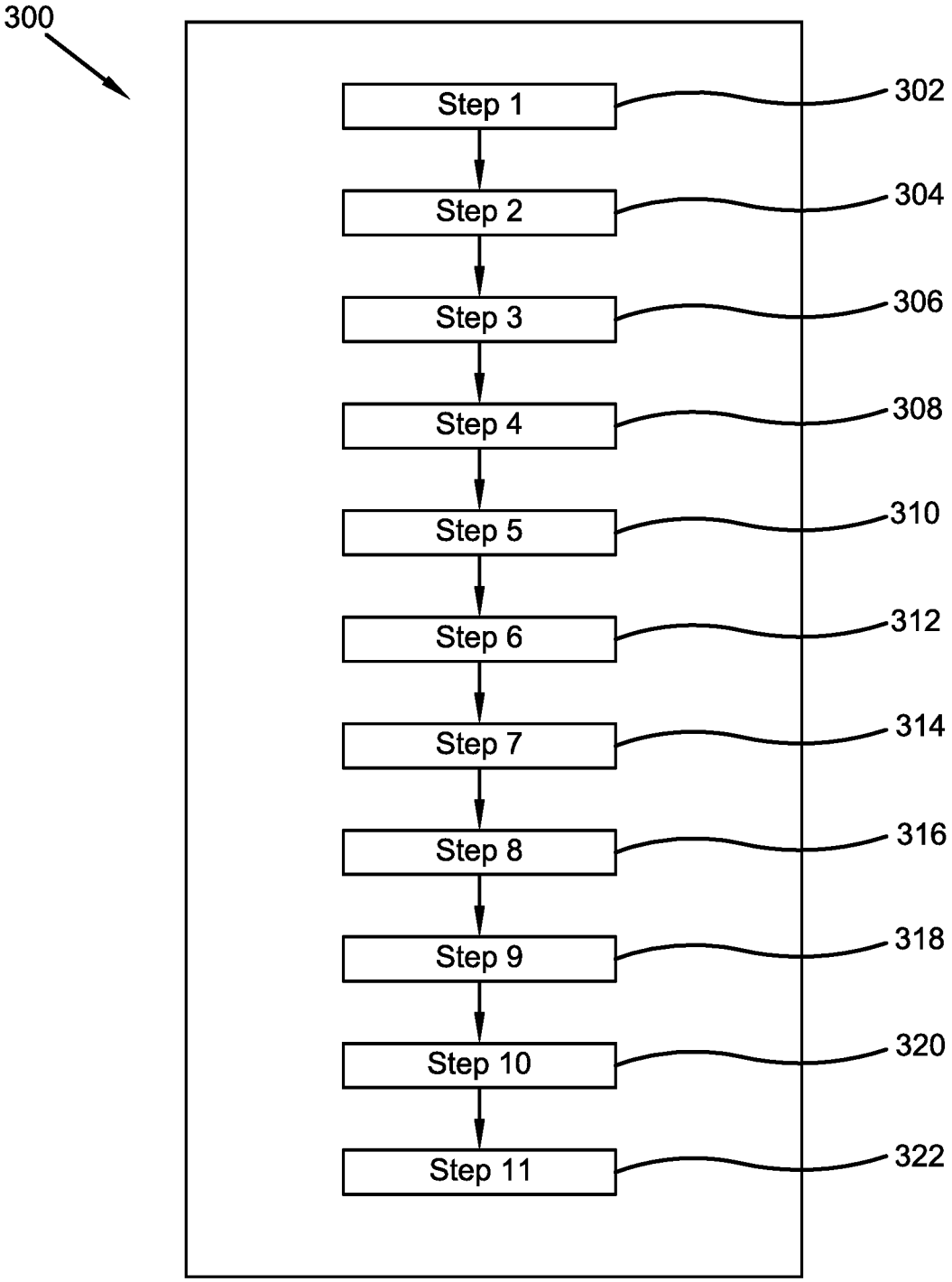
FIG. 5 illustrates a flowchart chart of a method of using one potential embodiment of a vacuum hose handle device of the present invention in accordance with the disclosed architecture.

FIG. 5 illustrates a flowchart chart of a method 300 of using one potential embodiment of a vacuum hose handle device 100 of the present invention in accordance with the disclosed architecture. First, a user takes the vacuum hose 20 and secures the hose 20 within the opening 122 on the first end 120 of the body 110 [Step 302]. Then, the user takes the vacuum attachment 30 and secures the attachment 30 into the opening 132 in the second end 130 of the body 110 [Step 304]. Next, the user places the handle 200 in the desired configuration using the rotating ring 140, if said embodiment is comprised of a rotating ring 140 [Step 306]. Then, a user can lock the handle 200 using the lock 142 [Step 308]. Next, a user can place the strap 150 around their arm 40 and fasten the strap fastener 152 [Step 310]. Then, the user can turn on the vacuum 10 [Step 312]. Then, the user can vacuum the desired area while directing the vacuum attachment 30 with the handle 200 of the device 100 [Step 314]. If the user wishes to stop vacuuming, they can press the button 144 on the body 110 to close the internal stopper [Step 316]. If the user wishes to change the handle 200 configuration while vacuuming, they can unlock the lock 144 and rotate the handle 200 around the rotating ring 140 to the desired configuration. [Step 318]. Then, when the user is done vacuuming, they can turn off the vacuum 10 and remove the vacuum hose 20 and the vacuum attachment 30 from the openings 122, 132 [Step 320]. Finally, the user can secure the device 100 to the vacuum using the fastener 114 located on the outer surface 112 of the body 110 [Step 322].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "vacuum hose handle device" and "device" are interchangeable and refer to the vacuum hose handle device 100 of the present invention.

Notwithstanding the foregoing, the vacuum hose handle device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the vacuum hose handle device 100 as shown in the FIGS. are for illustrative purposes only, and that many other sizes and shapes of the vacuum hose handle device 100 are well within the scope of the present disclosure. Although the dimensions of the vacuum hose handle device 100 are important design parameters for user convenience, the vacuum hose handle device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A vacuum hose handle device comprising:

a body comprised of a first end, a second end and a continuous opening extending therebetween;

a handle comprised of a grip; and an internal stopper positional within the continuous opening at the second end of the body operable via a button on an outer surface of the body, wherein the handle is magnetically attachable to the body.

2. The vacuum hose handle device of claim 1, wherein the body is further comprised of a first fastener.

3. The vacuum hose handle device of claim 2, wherein the handle removably attaches to the body via a second fastener that engages the first fastener.

4. The vacuum hose handle device of claim 1, wherein the grip is manufactured from a foam material.

5. A vacuum hose handle device comprising:

a body comprised of a first end, a second end and a continuous opening extending therebetween;

a handle comprised of a grip;

an internal stopper positional within the continuous opening at the second end of the body;

a rotating ring positioned along an outer surface of the body and fixedly attached to the handle;

a lock configured to secure the handle in a plurality of positions on the rotating ring; and a button, wherein the rotating ring is configured to rotate the handle 360 degrees around the body.

6. The vacuum hose handle device of claim 5, wherein the grip is a contoured grip.

7. The vacuum hose handle device of claim 6, wherein the grip is comprised of a non-slip rubber material.

8. The vacuum hose handle device of claim 5 further comprised of a strap.

9. The vacuum hose handle device of claim 8, wherein the strap is comprised of a fastener.

* * * * *